US007814991B2

(12) United States Patent
Abbasi et al.

(10) Patent No.: US 7,814,991 B2
(45) Date of Patent: Oct. 19, 2010

(54) PROCESS AND APPARATUS FOR SUBTERRANEAN DRILLING

(75) Inventors: Hamid A Abbasi, Naperville, IL (US); Iraj Salehi, Naperville, IL (US); Kent Perry, Schaumburg, IL (US)

(73) Assignee: Gas Technology Institute, Des Plaines, IL (US)

( * ) Notice: Subject to any disclaimer, the term of this patent is extended or adjusted under 35 U.S.C. 154(b) by 0 days.

(21) Appl. No.: 12/361,182

(22) Filed: Jan. 28, 2009

(65) Prior Publication Data

US 2010/0187010 A1 Jul. 29, 2010

(51) Int. Cl.
*E21B 10/26* (2006.01)

(52) U.S. Cl. ..... 175/57; 175/385; 175/394

(58) Field of Classification Search ..... 175/385, 175/386, 394, 57
See application file for complete search history.

(56) References Cited

U.S. PATENT DOCUMENTS 2,673,717 A * 3/1954 Bacon ..... 175/386
2,680,254 A * 6/1954 Hirschfeld ..... 7/158
2,816,737 A * 12/1957 Kinard et al. ..... 175/386
2,979,141 A 4/1961 Kandle
3,180,436 A 4/1965 Kellner et al.
4,320,544 A 3/1982 Bryant et al.
4,407,620 A 10/1983 Shinjo
4,536,107 A 8/1985 Sandy et al.
4,664,206 A 5/1987 Butler
4,734,972 A 4/1988 Hawkins
4,817,740 A 4/1989 Beimgraben
5,311,953 A 5/1994 Walker
5,641,027 A * 6/1997 Foster ..... 175/107
5,649,603 A 7/1997 Simpson et al.
6,333,036 B1 * 12/2001 Arminjon et al. ..... 424/201.1
7,090,034 B2 8/2006 Rives
2008/0257608 A1 10/2008 Fanuel et al.
2009/0020338 A1 1/2009 Stroud et al.

FOREIGN PATENT DOCUMENTS

WO 2004070159 8/2004

* cited by examiner

*Primary Examiner*—William P Neuder
(74) *Attorney, Agent, or Firm*—Mark E. Fejer

(57) ABSTRACT

A method and apparatus for drilling a subterranean formation or material utilizing a drilling apparatus which includes a drill string having a leading end and a trailing end and having a bottom hole assembly connected with the leading end. The bottom hole assembly includes a drill bit and an externally threaded screw section. In operation, the drill bit is rotated, forming material cuttings and an opening in the subterranean formation, and the threaded screw section is rotated within the opening, forming a helical groove in the subterranean formation.

26 Claims, 9 Drawing Sheets

PROCESS AND APPARATUS FOR SUBTERRANEAN DRILLING

BACKGROUND OF THE INVENTION

1. Field of the Invention

This invention relates to a method and apparatus for subterranean drilling. In one aspect, this invention relates to a method and apparatus for drilling in relatively hard subterranean formations, such as granite, limestone, sandstone and other rock formations as well as other materials such as concrete. In another aspect, this invention relates to a method and apparatus for horizontal subterranean drilling. In another aspect, this invention relates to a method and apparatus for performance of reworking operations in well bores.

2. Description of Related Art

Conventional subterranean drilling typically is performed using a rotary drill bit attached to a drill string. A drill string, which is normally associated with an oil well rig, is a column, or string, of drill pipe, or coiled tubing that transmits drilling fluid by means of one or more mud pumps and rotational power by means of a kelly drive or top drive or downhole motor to the drill bit. The drill string is hollow so that the drilling fluid can be pumped down to the bottom or end of a borehole through the interior of the string and circulated back up through the annulus formed between the drill string and the borehole wall. The drill string is typically made up of four sections: 1) bottom hole assembly; 2) transition pipe, also referred to as heavy weight drill collar; 3) drill pipe; and 4) drill stem subs. The bottom hole assembly typically comprises a drill bit which is used to break-up the rock formations and may also include other components such as a downhole motor, rotary steerable system, measurement while drilling (MWD), and logging while drilling (LWD) tools.

A heavyweight drill collar is used to provide a transition between the drill bit and drill pipe. This helps to reduce the number of fatigue failures seen directly above the bottom hole assembly. Drill pipe makes up the majority of a drill string, which may be up to 15,000 feet in length for an oil or gas well vertically drilled onshore in the United States and may extend to over 30,000 feet for an offshore deviated well. Drill stem subs are used to connect drill string elements.

A relatively modern drilling technique involves using coiled tubing instead of conventional drill pipe. Coiled tubing is metal piping which comes spooled on a large reel. This has the advantage of requiring less effort to trip in and out of the borehole (the coil can simply be run in and pulled out of the borehole while drill pipe must be assembled and dismantled joint by joint while tripping in and out). Instead of rotating the drill bit by using a rotary table or top drive at the surface, it is typically turned hydraulically by a downhole motor, powered by the motion of drilling fluid pumped from the surface. One of the benefits, as well as disadvantages, of coiled tubing is its flexibility, which facilitates directional drilling, but which also reduces the amount of force that can be applied to the drill bit when encountering hard underground formations and when drilling non-vertical boreholes.

The drill bit, which is one of the components of the bottom hole assembly, is typically made of alloy steel and comprises pieces of carbide or diamond cutting surfaces to break the hard material of the subterranean formation. The two most common types of drill bits are fixed cutter bits, which use polycrystalline diamond compact cutters to shear rock with a continuous scraping motion, and roller cone bits, which comprise teeth on wheels which turn as the drill string is rotated, thereby applying a crushing pressure to the rock, breaking it up into small pieces.

In most subterranean drilling applications, especially when drilling into harder materials, it is necessary to apply a certain amount of force on the drill bit to achieve the desired drilling speed. In vertical boreholes, when using a substantially rigid drill string, the force on the drill bit is controlled by the weight of the drill string above the drill bit. However, this method becomes less effective when drilling non-vertical or curved boreholes and even less effective when using a drill string of coiled tubing. Methods have been developed to improve the drilling speed in these applications, the most common of which involves the use of a tractor which anchors to the surface of the drilled borehole above the bit while the downstream drill string is powered forward using electrical or hydraulic force. Although effective in many instances, these tractor systems are expensive and have difficulties in maneuvering through softer formations where the surface breaks down and, thus, do not provide the needed anchoring.

SUMMARY OF THE INVENTION

It is one object of this invention to provide a method and apparatus for subterranean drilling which addresses the above described issues associated with conventional drilling methods and systems.

The issues described herein above may be addressed, in accordance with one embodiment of this invention, by a method for drilling a subterranean formation or material in which an apparatus comprising a drill string having a leading end and a trailing end and having a bottom hole assembly connected with the leading end is introduced into a borehole proximate the subterranean formation. The bottom hole assembly comprises a drill bit and an externally threaded screw section upstream of the drill bit having a major diameter greater than the diameter of the drill bit. The major diameter is the distance across the screw section from thread peak to thread peak. The drill bit is rotated into the subterranean formation of interest, forming material cuttings and an opening in the subterranean formation after which the threaded screw section is rotated within the opening, forming a helical groove in the subterranean formation. Using the bottom hole assembly first to drill an opening into the subterranean formation and second to create a helical groove in the wall of the formation defining the opening in accordance with one embodiment of the method of this invention utilizes the axial force created by the rotating and progressing threaded screw section to increase pull force on the drill string with which the bottom hole assembly is connected. This, in turn, reduces the amount of force required to be applied to the bottom hole assembly from upstream of the bottom hole assembly, making it particularly suitable for use with coiled tubing drill strings. In accordance with one embodiment of this invention, the bottom hole assembly further comprises a drilling section upstream of the screw section. As the screw section progresses into the opening, the axial force created by the progressing screw section imparts a pull force on the drilling section, resulting in an increase in drilling speed as well as drilling efficiency.

BRIEF DESCRIPTION OF THE DRAWINGS

These and other objects and features of this invention will be better understood from the following detailed description taken in conjunction with the drawings wherein.

DETAILED DESCRIPTION OF THE PRESENTLY PREFERRED EMBODIMENTS

Figure 1:
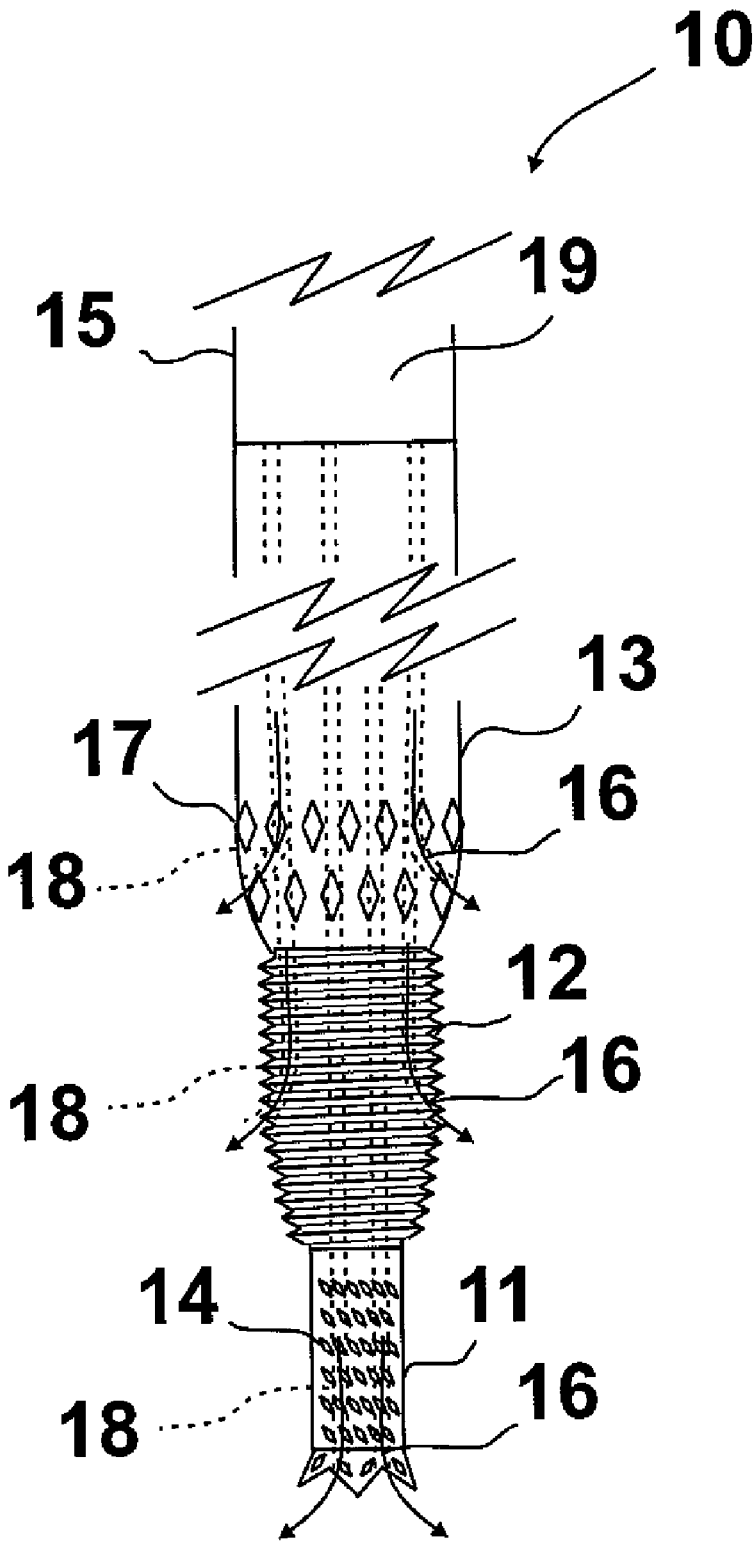
FIG. 1 is a schematic lateral view of a bottom hole assembly for use in accordance with one embodiment of the method of this invention.
Figure 2:
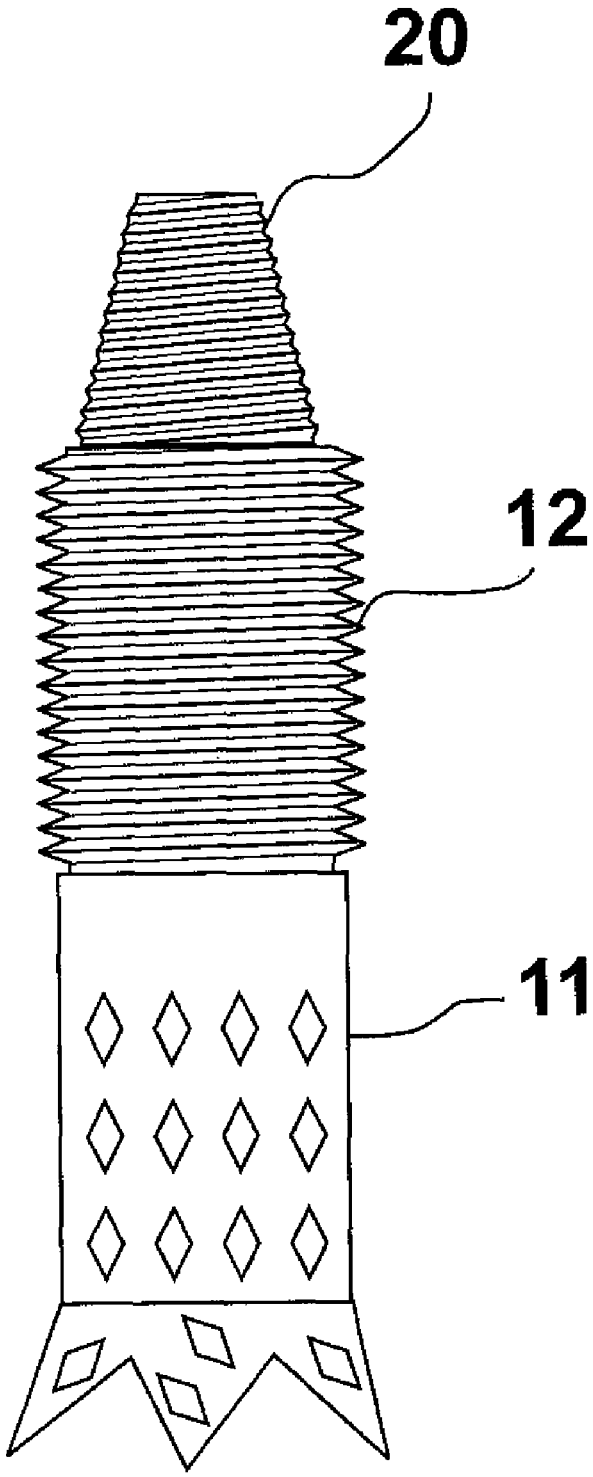
FIG. 2 is a schematic lateral view of a bottom hole assembly for use in accordance with another embodiment of the method of this invention.
Figure 8:
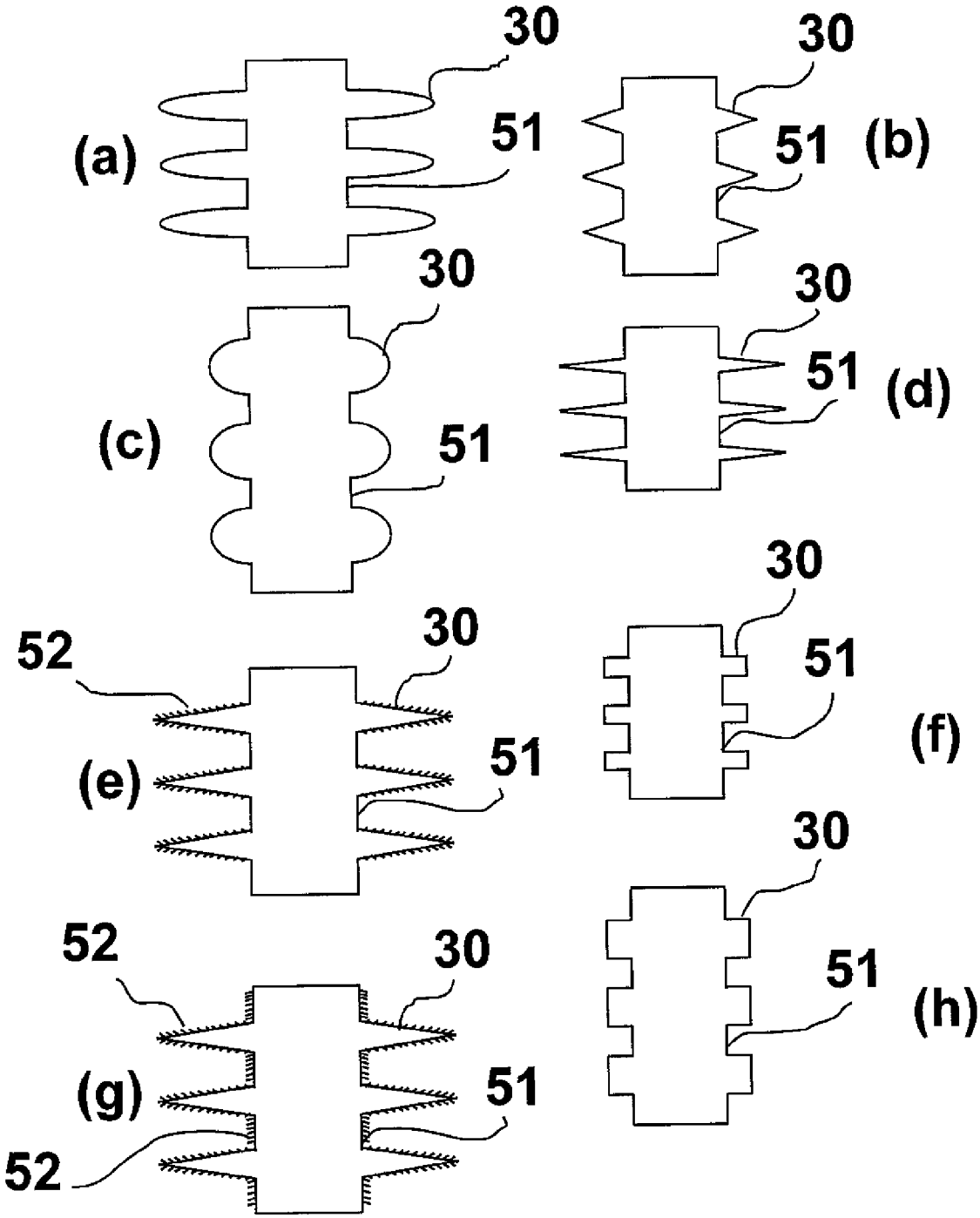
FIG. 8 is a schematic diagram of a variety of screw flight profiles suitable for use in the threaded screw section of the bottom hole assembly of this invention.

FIG. 1 shows a bottom hole assembly for drilling subterranean formations in accordance with one embodiment of this invention. As shown therein, bottom hole assembly 10 comprises drill bit 11 having cutting surfaces 14, threaded screw section 12 upstream of drill bit 11, and drilling section 13 having cutting surfaces 17 upstream of threaded screw section 12, and is connected with the leading end of drill string 15. In accordance with one embodiment of this invention as shown in FIG. 2, a threaded drill string connection section 20 is provided for connection of the bottom hole assembly with the drill string. To enable threaded screw section 12 to engage with the wall of the borehole produced by drill bit 11, the major diameter (i.e. thread peak to thread peak) of the threaded screw section is greater than the diameter of the drill bit and, thus, the diameter of the borehole created by the drill bit. The threads of the threaded screw section may vary in depth, shape, pitch, and materials of construction to match the material being drilled. FIG. 8 shows a variety of screw thread profiles (a)-(h) which may be employed in the threaded screw section of the bottom hole assembly of this invention. It will be appreciated by those skilled in the art that other screw thread profiles not shown in FIG. 8 may be employed, and such screw thread profiles are deemed to be within the scope of this invention. To facilitate penetration of the threaded screw section, the screw flights 30 and/or the valleys 51 between the screw flights may be covered with particles 52 of a cutting material as shown in connection with screw thread profiles e and g in FIG. 8.

Figure 4:
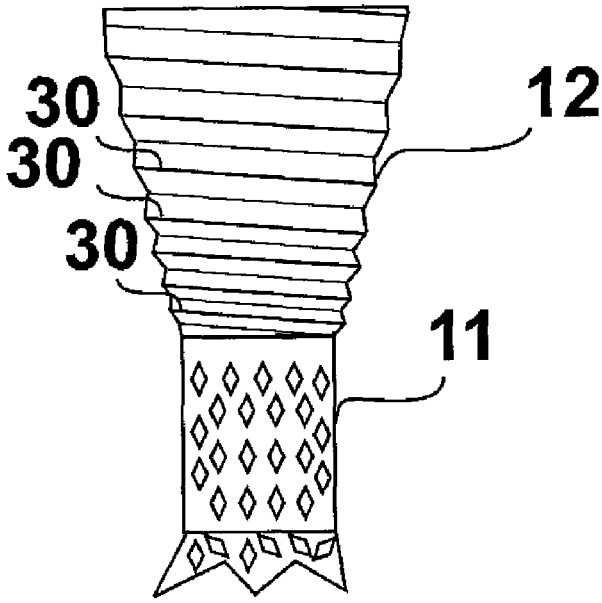
FIG. 4 is a schematic diagram of a bottom hole assembly having a tapered screw section with variable distances between flights in accordance with one embodiment of this invention.
Figure 5:
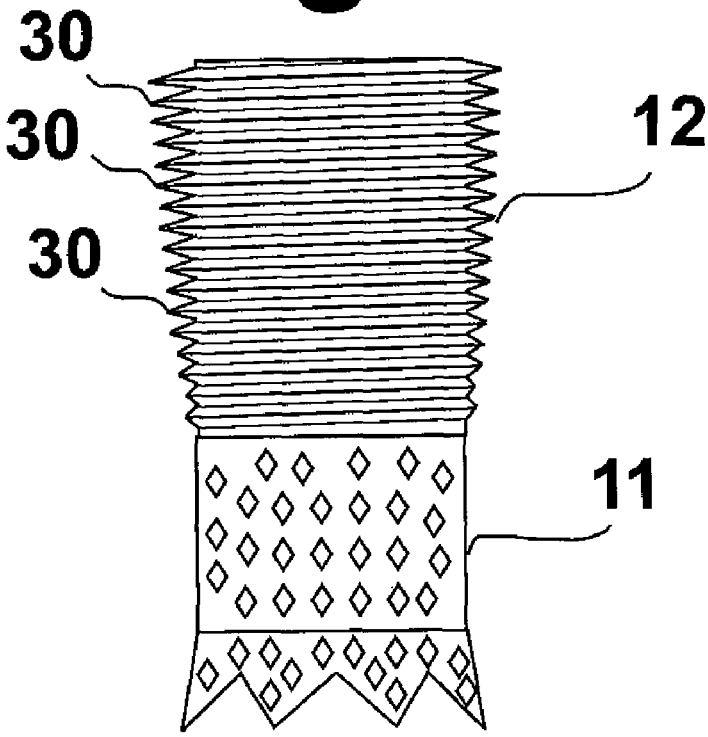
FIG. 5 is a schematic diagram of a bottom hole assembly in accordance with one embodiment of this invention having a threaded screw section with variable depth threads.

In accordance with one embodiment of this invention as shown in FIG. 4, the threaded screw section 12 is tapered in the direction of the drill bit 11, i.e. the larger diameter portion of the taper oriented toward the drill string, and the distance between the screw flights or thread peaks 30 increases with distance from the drill bit. In accordance with one embodiment of this invention, the height of the screw flights 30 increases in a direction away from the drill bit as shown in FIG. 5.

Figure 3:
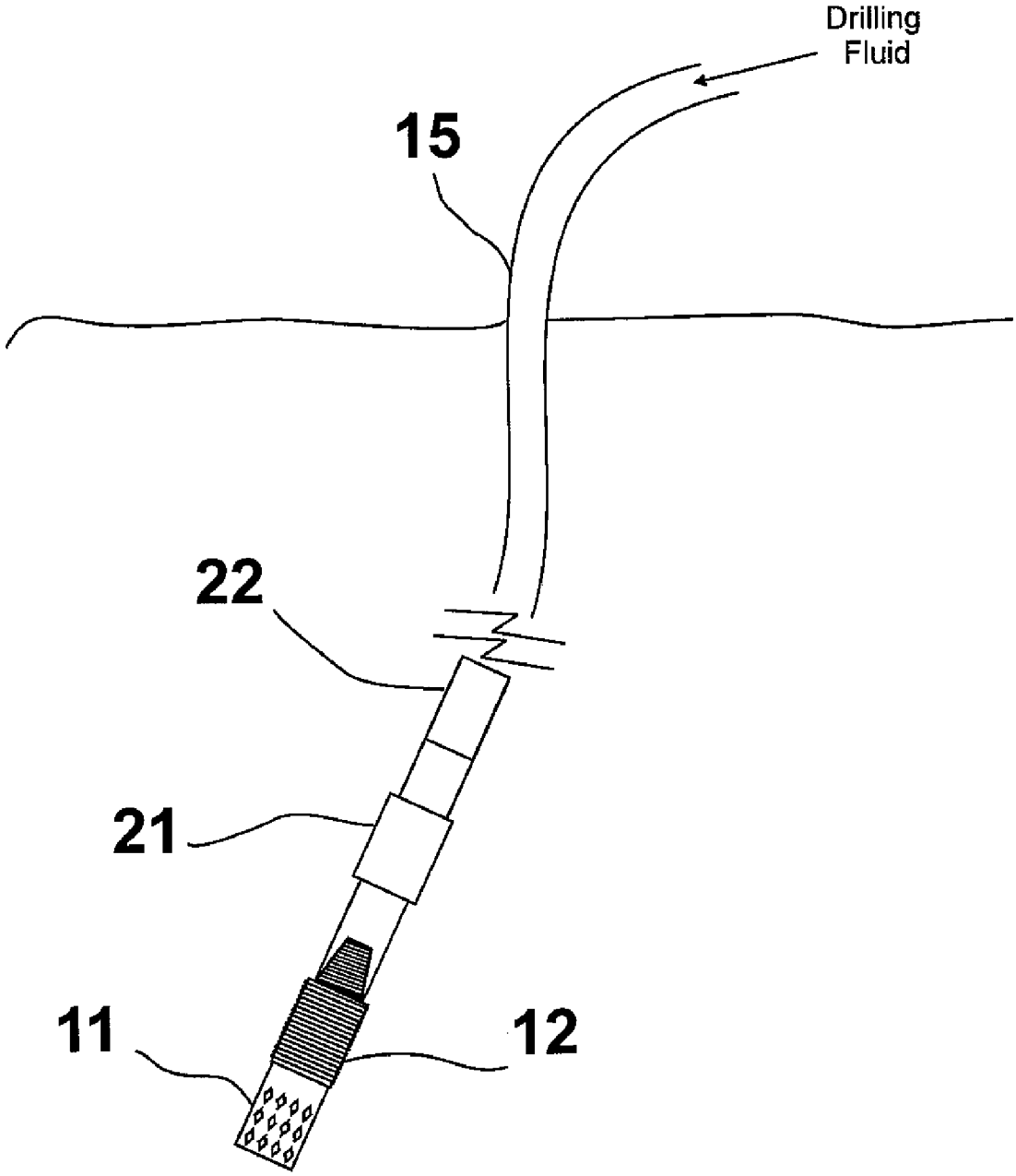
FIG. 3 is a schematic diagram of a portion of a drilling apparatus employing a bottom hole assembly in accordance with one embodiment of this invention.
Figure 9:
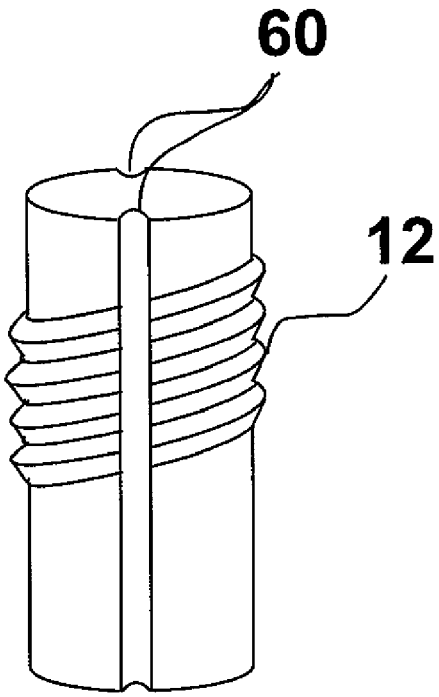
FIG. 9 is a schematic diagram showing a portion of a bottom hole assembly in accordance with one embodiment of this invention with channels enabling the removal of drilling fluid and debris from the drilling site.
Figure 10:
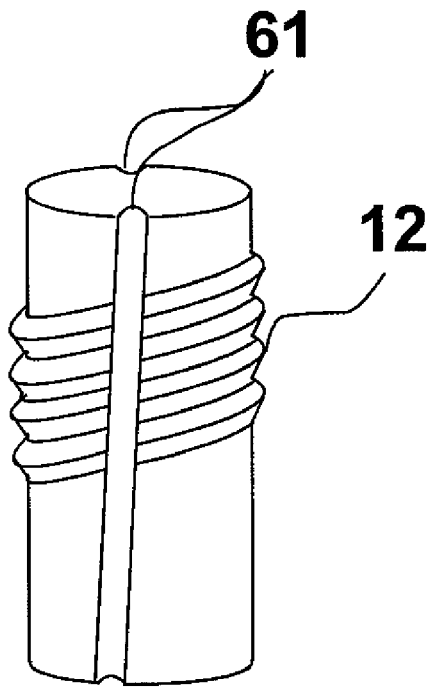
FIG. 10 is a schematic diagram showing a portion of a bottom hole assembly with channels enabling the removal of drilling fluid and debris from the drilling site in accordance with another embodiment of this invention.
Figure 11:
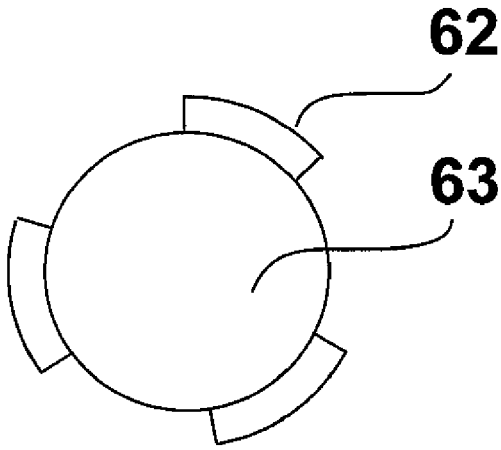
FIG. 11 is an axial view of the threaded screw section of a bottom hole assembly showing flights of less than 360° in accordance with one embodiment of this invention.

As previously indicated, it is the common practice of drilling operators to introduce liquid fluids, also referred to as "mud", into the borehole, typically through the drill string as shown in FIG. 3, for cooling of the drill bit and removal of debris or cuttings generated by the drilling process. In some instances, the liquid fluid may include solid particles. Gaseous cooling fluids, such as air, may also be used for this purpose. In accordance with one embodiment of this invention as shown in FIG. 1, the bottom hole assembly forms a plurality of internal channels 18 through which a fluid flowing through an interior fluid flow channel 19 of the drill string flows for cooling of the assembly as suggested by arrows 16. During the cooling operation, the cooling fluid and/or cuttings and debris may be removed by means of one or more channels formed by one or more sections of the bottom hole assembly. FIGS. 9 and 10 show channels 60 disposed parallel with the longitudinal axis of the bottom hole assembly and channels 61 disposed at an angle with respect to the longitudinal axis formed by the threaded screw section 12. Channels 60 and 61 may be formed in accordance with one embodiment of this invention by the use of discontinuous or segmented screw flights. FIG. 11 shows an axial view of the threaded screw section in accordance with one embodiment of this invention having one flight 62 of less than 360° around the center portion of the shaft 63 of the threaded screw section. Threaded screw sections with more than one such flight may also be employed. In addition to providing channels for the removal of cooling fluids and debris from the drill site, the partial or segmented screw flights reduce surface friction with the borehole wall, thereby facilitating rotation of the threaded screw section 12.

In accordance with one embodiment of this invention as shown in FIG. 3, the bottom hole assembly further comprises a reamer section 21 disposed upstream of the threaded screw section. The reamer section, which has an outer diameter greater than the major diameter of the threaded screw section, is used to enlarge the borehole so as to facilitate the trip out of the borehole by the bottom hole assembly.

Figure 12:
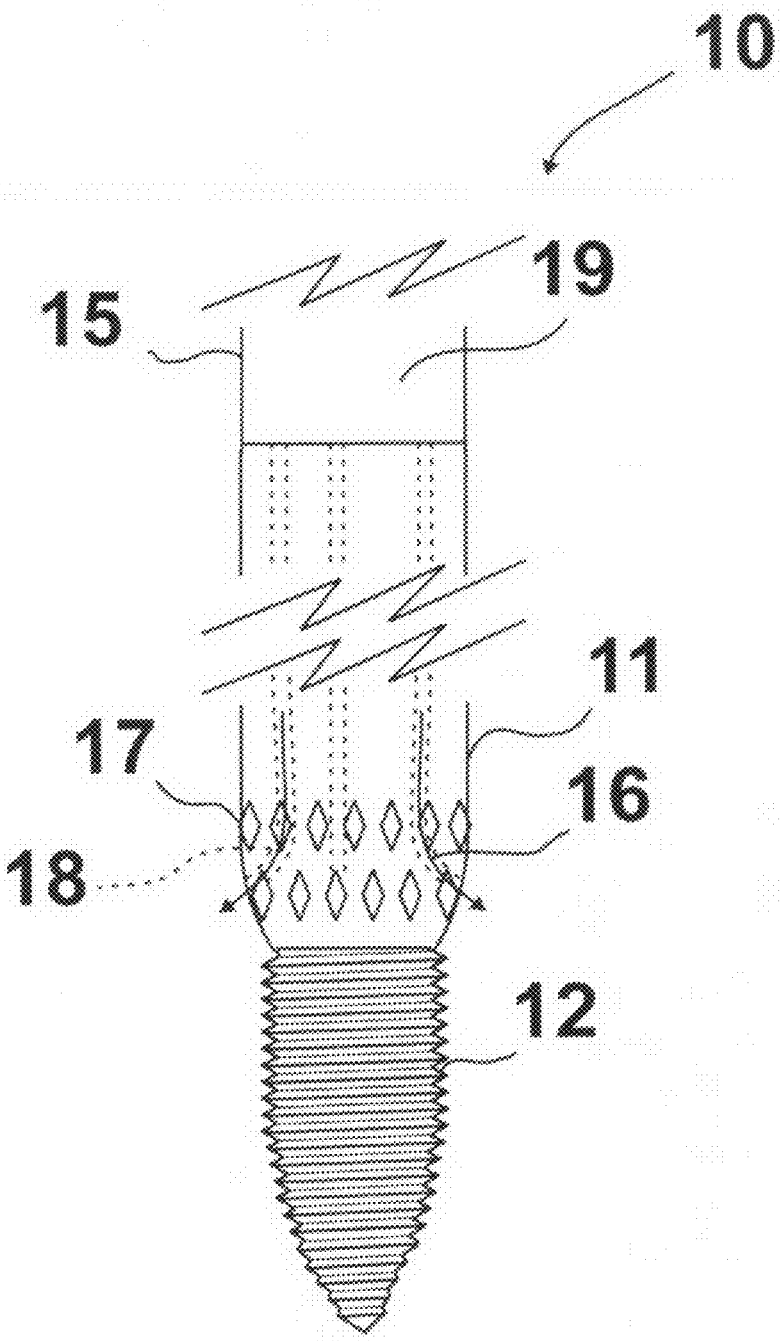
FIG. 12 is a schematic diagram of a bottom hole assembly in accordance with one embodiment of this invention.

In addition to drilling, this invention is suitable for use in work over applications, e.g. enlarging the borehole, in which there is no need for a drill bit ahead of the screw section. Rather, the forward end of the bottom hole assembly in accordance with one embodiment of this invention comprises a threaded screw section 12 with a reamer section 21 and/or drill bit 11 disposed upstream thereof as shown in FIG. 12. To ensure engagement of the threaded screw section, the maximum diameter of the screw, i.e. flight peak-to-flight peak, must be larger than the diameter of the borehole.

Figure 6:
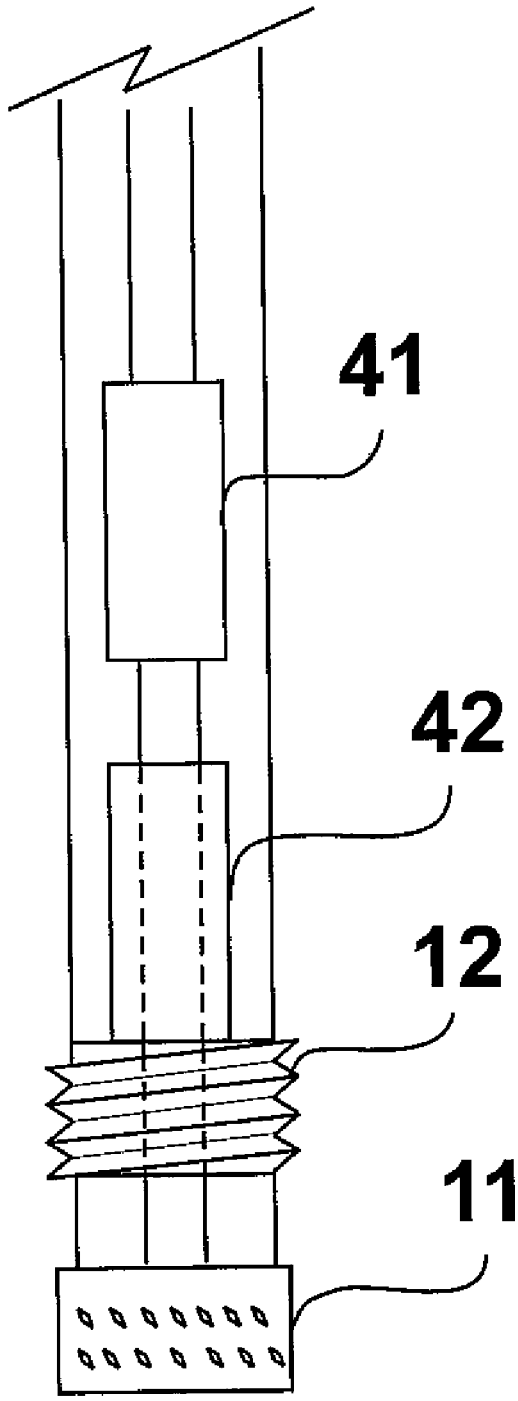
FIG. 6 is a schematic diagram of a bottom hole assembly in accordance with one embodiment of this invention in which the drill bit and the screw section are independently operable.
Figure 7:
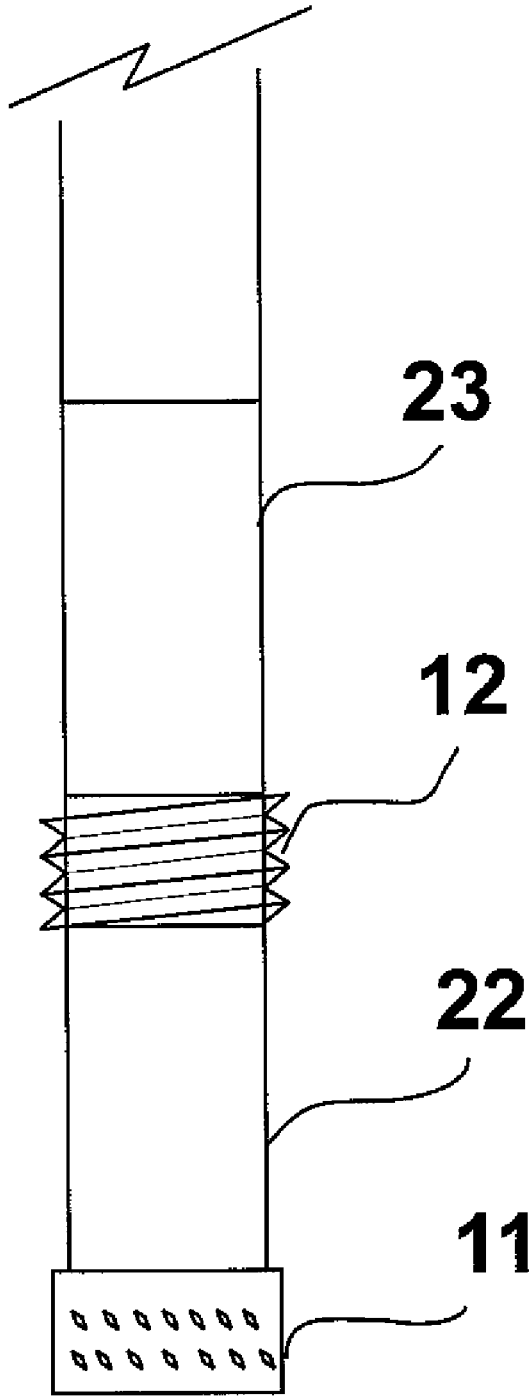
FIG. 7 is a schematic diagram of a bottom hole assembly in accordance with one embodiment of this invention comprising a drill steering tool.

As is conventional, a mud motor 22 disposed upstream of the bottom hole assembly may be used to drive and steer the components of the assembly. Other drive means for driving the components of the assembly may be electric motors and pneumatic drives. In accordance with one embodiment of this invention, each section of the bottom hole assembly is operable independently of the other sections. This may be achieved, for example, by the use of a plurality of mud motors 41 and 42, each operably connected with one of the threaded screw section 43 and drill bit 44 as shown in FIG. 6. In accordance with one embodiment of this invention, independent rotatability of adjacent sections of the bottom hole assembly is achieved through the use of suitable bearings disposed between the sections. Alternatively, drive means such as a mud motor may be disposed between sections of the bottom hole assembly. FIG. 7 shows one embodiment of this invention in which mud motor 22 is disposed between drill bit 11 and threaded screw section 12. In this case, an additional drive means 23 is disposed upstream of the threaded screw section for driving thereof. To the extent that the bottom hole assembly comprises additional components, the additional components may also be independently rotatable. In accordance with one embodiment, sections of the bottom hole assembly are rotated in opposite directions to counterbalance torque on the drill string.

In accordance with one embodiment of this invention, the components comprising the bottom hole assembly may be rotated in a step-wise, or intermittent, fashion as opposed to continuous rotation. Such intermittent rotation may be achieved by any of a number of known means, such as an impact mechanism usually employed in residential, commercial, and industrial power tools, wherein the impact may be generated by electric, pneumatic, or hydraulic means.

The method and apparatus of this invention provide increases in efficiency and/or drilling speed of drilling systems for drilling holes in relatively hard substances, such as concrete, granite, limestone, marble, quartz, and the like by locally increasing the force on the drill bit, as opposed to increasing the force by way of forces applied above ground to the drill string or by using other means such as tractors. The method and apparatus may be used for a wide range of drilling operations as well as wellbore reworking operations and are especially useful for drilling non-vertical boreholes in the ground for producing and recovering oil, gas, water, and geothermal energy. The method and apparatus of this invention may also be used for drilling smaller boreholes for logging, for side tracking through existing boreholes, and for smoothing existing boreholes. The method and apparatus of this invention may be used to drill boreholes of a variety of sizes but are especially suitable for drilling boreholes in the range of about 0.5 inches to 20 inches in diameter.

In accordance with one embodiment, the method of this invention comprises drilling a hole into the subterranean formation, removing the drilled material, forcing a rotating cutting threaded screw section into the hole, cutting a helical groove in the subterranean formation as the screw section progresses into the material, removing the cuttings, utilizing the axial force created by the progressing screw section to increase pull on the drill bit ahead of the threaded screw section. In accordance with one embodiment of this invention, the axial force created by the progressing screw section is utilized to increase pull on a drilling section upstream of the threaded screw section, thereby increasing the force on the drilling section against the material and consequently the drilling speed and efficiency of the bottom hole assembly. In both instances, a cooling fluid, such as a drilling mud, is circulated through and around the bottom hole assembly to cool the assembly and carry away the cuttings. A unique feature of the method of this invention is its ability to generate the requisite pull force as needed based on the hardness of the material being drilled. In this sense, the method is somewhat self compensating. The application of pull force, being local as opposed to being applied to the entire drill string, is superior to a comparable push force applied through conventional means for drilling as it does not cause buckling of the coiled tubing between the surface and the drill bit, workover, as well as side tracking. The pull force generated by the method of this invention may allow the use of smaller diameter, thinner, and/or flexible coiled tube, which would be cheaper and easier to steer for more precise directional control.

In accordance with one embodiment of this invention, the drill bit ahead of the threaded screw section is a pilot bit used to make a small diameter, substantially round hole in the material being drilled. This may be accomplished using a variety of drilling means including rotary bit drilling, percussion bit drilling, impact drilling, high velocity liquid, drilling mud, or slurry jet, laser, microwave, sonic, or plasma jet.

The primary advantages of this invention compared with conventional technology include the use of the bottom hole assembly itself as a means for increasing drilling force, the ability to provide at least some adjustment of the force to match the drilling characteristics of the material being drilled, and the application of a pull force on the drill string which enables a higher conversion efficiency of applied force to realized force, use of smaller diameter and thinner wall drill strings, more control over the direction of the drilling, and less tendency for buckling of the drill string due to applied force.

While in the foregoing specification this invention has been described in relation to certain preferred embodiments thereof and many details have been set forth for purpose of illustration, it will be apparent to those skilled in the art that the invention is susceptible to additional embodiments and that certain of the details described herein can be varied considerably without departing from the basic principles of the invention.

We claim:

1. A method for drilling, enlarging, extending, or cleaning a borehole in a subterranean formation or material comprising the steps of:

introducing an apparatus comprising a drill string having a leading end and a trailing end and having a bottom hole assembly connected with said leading end into a borehole in said material or proximate said subterranean formation, said bottom hole assembly comprising a drill bit, an externally threaded screw section upstream of said drill bit having a screw section diameter greater than a drill bit diameter of said drill bit and a reaming section upstream of said screw section;

rotating said drill bit, forming material cuttings and an opening in said subterranean formation or material;

rotating said screw section within said opening, forming a helical groove in said subterranean formation or material: and rotating said reaming section, enlarging said opening.

2. The method of claim 1, wherein a fluid is introduced into said drill string and transported to said leading end.

3. The method of claim 2, wherein said bottom hole assembly is cooled by said fluid.

4. The method of claim 2, wherein said bottom hole assembly forms at least one external channel through which said material cuttings are removed from said opening by said fluid.

5. The method of claim 1, wherein said drill bit and said threaded screw section are independently rotated and controlled.

6. The method of claim 1, wherein said drill bit, said threaded screw section and said reaming section are independently rotated and controlled.

7. The method of claim 1, wherein said threaded screw section comprises uniformly sized flights providing a uniform said helical groove.

8. The method of claim 1, wherein said threaded screw section comprises flights sized to provide at least one of progressively deeper grooves and progressively wider grooves as said threaded screw section progresses into said opening.

9. The method of claim 1, wherein said drill string comprises coiled tubing.

10. The method of claim 3, wherein said bottom hole assembly forms at least one throughbore in fluid communication with said drill string, whereby said bottom hole assembly is cooled by said fluid flowing through said at least one throughbore.

11. The method of claim 1, wherein at least one of said drill bit and said threaded screw section are rotated in a step-wise manner.

12. The method of claim 6, wherein at least one of said drill bit, said threaded screw section, and said reaming section is rotated in opposite directions.

13. In an underground drilling apparatus having a bottom hole assembly (10) comprising a drill bit (11) and a drill string (15) connected with said bottom hole assembly, the improvement comprising:

said bottom hole assembly (10) comprising said drill bit (11), an externally threaded screw section (12) upstream of said drill bit, said threaded screw section having a screw section major diameter greater than a drill bit diameter of said drill bit, and a reaming section (21) upstream of said threaded screw section having a reaming section diameter greater than said screw section major diameter.

14. The apparatus of claim 13, wherein said threaded screw section is tapered in a direction of said drill bit.

15. The apparatus of claim 13, wherein said drill bit and said threaded screw section are connected with each other in a manner such that said drill bit and said threaded screw section are independently rotatable.

16. The apparatus of claim 13, wherein said bottom hole assembly (10) further comprises a drilling section (13) disposed upstream of said threaded screw section (12), said drilling section comprising at least one cutting surface (14) and having a drilling section diameter greater than said screw section diameter.

17. The apparatus of claim 13, wherein said drill bit and said screw section are spaced apart.

18. The apparatus of claim 13, wherein said drill string comprises a coiled tubing.

19. The apparatus of claim 13, wherein said bottom hole assembly forms at least one throughbore (18) in fluid communication with an interior fluid flow channel (19) of said drill string (15) for passage of a fluid through said bottom hole assembly (10).

20. The apparatus of claim 14, wherein said threaded screw section comprises threads having at least one of variable pitches, variable depths, variable thread shapes, and variable thread angles.

21. The apparatus of claim 13, wherein at least one of said drill bit and said threaded screw section form at least one exterior channel for removal of cooling fluid and debris from a bottom of a borehole.

22. The apparatus of claim 13, wherein threads of said threaded screw section are segmented.

23. In an underground drilling apparatus having a bottom hole assembly (10) comprising a drill bit (11) and a drill string (15) connected with said bottom hole assembly, the improvement comprising:

said bottom hole assembly (10) comprising a threaded screw section (12) disposed at a forward end of said bottom hole assembly and at least one of said drill bit (11) and a reaming section (21) disposed rearward of said threaded screw section connected with said threaded screw section and having a diameter greater than a maximum diameter of said threaded screw section.

24. The apparatus of claim 23, wherein said threaded screw section, said drill bit, and said reamer section are connected with each other in a manner so as to be independently rotatable.

25. The apparatus of claim 23, wherein said drill string comprises a coiled tubing.

26. The apparatus of claim 23, wherein said bottom hole assembly forms at least one throughbore in fluid communication with an interior fluid flow channel of said drill string for passage of a fluid through said bottom hole assembly.

* * * * *